US010876447B1

(12) United States Patent
Henson et al.

(10) Patent No.: US 10,876,447 B1
(45) Date of Patent: Dec. 29, 2020

(54) DIAGNOSTIC SYSTEM AND METHOD FOR DETECTING LEAKS AND DISCONNECTS IN A CRANKCASE VENTILATION SYSTEM

(71) Applicants: Scott E Henson, Chelsea, MI (US); Dhaval D Shah, Rochester Hills, MI (US); Ryan J Schulten, Jackson, MI (US); Balmkund B Agarwal, Farmington Hills, MI (US)

(72) Inventors: Scott E Henson, Chelsea, MI (US); Dhaval D Shah, Rochester Hills, MI (US); Ryan J Schulten, Jackson, MI (US); Balmkund B Agarwal, Farmington Hills, MI (US)

(73) Assignee: FCA US LLC, Auburn Hills, MI (US)

( * ) Notice: Subject to any disclaimer, the term of this patent is extended or adjusted under 35 U.S.C. 154(b) by 42 days.

(21) Appl. No.: 16/444,042

(22) Filed: Jun. 18, 2019

(51) Int. Cl.

| | |
|---|---|
| ***F01M 13/04*** | (2006.01) |
| ***F02M 25/06*** | (2016.01) |
| ***F02M 35/10*** | (2006.01) |
| ***F02D 41/22*** | (2006.01) |

(52) U.S. Cl.
CPC ..... *F01M 13/04* (2013.01); *F02M 25/06* (2013.01); *F02D 41/22* (2013.01); *F02D 2250/08* (2013.01); *F02M 35/10157* (2013.01); *F02M 35/10373* (2013.01)

(58) Field of Classification Search
CPC .. F01M 13/04; F02M 25/06; F02M 35/10373; F02M 35/10157; F02D 41/22; F02D 2250/08
See application file for complete search history.

(56) References Cited

U.S. PATENT DOCUMENTS

| | | | |
|---|---|---|---|
| 5,792,949 | A | 8/1998 | Hewelt et al. |
| 7,080,547 | B2 | 7/2006 | Beyer et al. |
| 8,261,548 | B2 | 9/2012 | Ofner |
| 9,068,486 | B2 | 6/2015 | Rollinger et al. |
| 9,109,523 | B2 | 8/2015 | Surnilla et al. |
| 9,127,578 | B2 | 9/2015 | Pursifull et al. |
| 9,127,976 | B2 | 9/2015 | Pursifull |
| 9,207,142 | B2 | 12/2015 | Nethercutt et al. |
| 9,303,592 | B2 | 4/2016 | Pursifull |
| 9,316,131 | B2 | 4/2016 | Rollinger et al. |
| 9,382,823 | B2 | 7/2016 | Rollinger et al. |
| 10,043,352 | B2 | 8/2018 | Henson et al. |
| 2014/0081548 | A1 | 3/2014 | Pursifull et al. |
| 2014/0081549 | A1 | 3/2014 | Rollinger et al. |
| 2014/0081550 | A1 | 3/2014 | Jentz et al. |
| 2016/0195449 | A1 | 7/2016 | Haslbeck et al. |

*Primary Examiner* — Jacob M Amick
*Assistant Examiner* — Charles Brauch
(74) *Attorney, Agent, or Firm* — Ralph E Smith

(57) ABSTRACT

A diagnostic system and method for a crankcase ventilation system of an engine having a boost system utilize a pressure sensor configured to measure a pressure in a make-up air (MUA) hose, a flow-limiting valve (i) fixedly attached to the induction system at a point upstream from the pressure sensor and proximate to an induction system end of the MUA hose and (ii) configured to limit flow through the MUA hose, and a controller configured to, in response to detecting the non-boost operating condition of the engine, obtain an initial pressure from the pressure sensor and then command the flow-limiting valve to close for a diagnostic period, during which monitor the pressure is monitored to determine a pressure drop from the initial pressure, and when the pressure drop fails to exceed a threshold during the diagnostic period, detect a malfunction indicative of a leaking or disconnected MUA hose.

16 Claims, 3 Drawing Sheets

DIAGNOSTIC SYSTEM AND METHOD FOR DETECTING LEAKS AND DISCONNECTS IN A CRANKCASE VENTILATION SYSTEM

FIELD

The present application generally relates to engine crankcase ventilation systems and, more particularly, to a diagnostic system and method for detecting leaks and disconnects in a crankcase ventilation system.

BACKGROUND

An engine draws fresh air into an intake manifold through an induction system (e.g., an intake duct having an air filter). A throttle valve is implemented downstream from the air filter and controls airflow through the induction system and into the intake manifold. The air in the intake manifold is distributed to a plurality of cylinders and combined with a fuel (e.g., via port or direct fuel injection) to create an air/fuel mixture. This air/fuel mixture is compressed by pistons within the cylinders (the compression stroke) and the compressed air/fuel mixture is ignited (e.g., by spark from spark plugs). Piston rings are used to form a seal between the pistons and walls of the cylinders. The combustion of the compressed air/fuel mixture (the power stroke) drives the pistons, which rotatably turn a crankshaft to generate drive torque. Exhaust gas resulting from combustion is expelled from the cylinders into an exhaust system where it is treated before being released into the atmosphere.

The crankshaft is housed by a crankcase that includes lubricating fluid (e.g., oil). During the compression and power strokes, the air/fuel mixture (i.e., unburnt fuel) or exhaust gas sometimes escape the combustion chamber past the piston rings and enters the crankcase, which is also known as blow-by. Crankcase ventilation systems are therefore implemented to handle these blow-by vapors, which could dilute and/or degrade the oil over time, thereby decreasing its ability to lubricate the crankshaft. Crankcase ventilation systems typically include a positive crankcase ventilation (PCV) hose and a PCV valve to control venting blow-by vapors from the crankcase and back into the intake manifold. More specifically, engine vacuum draws the blow-by vapors from the crankcase through an oil separator (e.g., a baffle) that removes any oil from the blow-by vapors and the blow-by vapor flow through the PCV hose is controlled by the PCV valve.

Crankcase ventilation systems typically also include a make-up air (MUA) hose. This MUA hose is connected to the crankcase and to the induction system at a point upstream from the intake manifold (e.g., before the throttle valve and after the air filter). The MUA hose is used to provide fresh air to the crankcase to better flush out the blow-by vapors. Emissions standards require detection of leaks in the crankcase ventilation system, which could cause blow-by vapors (e.g., unburnt fuel or untreated exhaust gas) to be expelled into the atmosphere. One such potential leak is a disconnected MUA hose or a leak therein. Conventional diagnostic systems monitor pressure pulsations in the MUA hose, but these pressure pulsations occur often in boosted (e.g., supercharged) engines and thus may not be indicative of a leaking or disconnected MUA hose. Accordingly, while such diagnostic systems work well for their intended purpose, there remains a need for improvement in the relevant art.

SUMMARY

According to one example aspect of the invention, a diagnostic system for a crankcase ventilation system of an engine having a boost system is presented. In one exemplary implementation, the diagnostic system comprises: a pressure sensor configured to measure a pressure in a make-up air (MUA) hose or a crankcase of a crankcase ventilation system, the MUA hose connecting an induction system of the engine at a point upstream from an intake manifold of the engine to the crankcase, a flow-limiting valve (i) fixedly attached to the induction system at a point upstream from the pressure sensor and proximate to an induction system end of the MUA hose and (ii) configured to limit flow through the MUA hose, and a controller configured to detect a non-boost operating condition of the engine and, in response to detecting the non-boost operating condition of the engine: obtain an initial pressure from the pressure sensor, after obtaining the initial pressure, command the flow-limiting valve to close for a diagnostic period, during the diagnostic period, monitor the pressure using the pressure sensor to determine a pressure drop from the initial pressure, and when the pressure drop fails to exceed a threshold during the diagnostic period, detect a malfunction indicative of a leaking or disconnected MUA hose.

In some implementations, the engine comprises distinct first and second banks of cylinders, wherein the MUA hose is connected to the crankcase via the first bank of cylinders, and wherein the crankcase ventilation system further comprises a positive crankcase ventilation (PCV) valve disposed along a PCV hose that connects the intake manifold of the induction system to the second bank of cylinders. In some implementations, the non-boost operating condition of the engine includes the PCV valve being open thereby fluidly connecting the intake manifold having an engine vacuum pressure level to the crankcase and the MUA hose. In some implementations, the non-boost operating condition of the engine is a stabilized, warm idle operating condition.

In some implementations, the controller is further configured to command the flow-limiting valve to open in response to a first of (i) the pressure drop reaching the threshold and (ii) an end of the diagnostic period. In some implementations, the flow-limiting valve defines an orifice sized to prevent a maximum vacuum level from being reached that could potentially damage seals of the engine. In some implementations, the boost system is a supercharger. In some implementations, in response to detecting the malfunction, the controller is further configured to at least one of (i) actuate a malfunction indicator lamp (MIL) and (ii) set a diagnostic trouble code (DTC).

According to another example aspect of the invention, a diagnostic method for a crankcase ventilation system of an engine having a boost system is presented. In one exemplary implementation, the diagnostic method comprises: detecting, by a controller of the engine, a non-boost operating condition of the engine and in response to detecting the non-boost operating condition of the engine: obtaining, by the controller, an initial pressure from a pressure sensor configured to measure a pressure in an MUA hose or a crankcase of the crankcase ventilation system, the MUA hose connecting an induction system of the engine at a point upstream from an intake manifold of the engine to the crankcase, after obtaining the initial pressure, commanding, by the controller, a flow-limiting valve closed for a diagnostic period, the flow-limiting valve being (i) fixedly attached to the induction system upstream from the pressure sensor and proximate to an induction system end of the MUA hose and (ii) configured to limit flow through the MUA hose, during the diagnostic period, monitoring, by the controller, the pressure using the pressure sensor to determine a pressure drop from the initial pressure, and when the pressure drop fails to exceed a threshold during the diagnostic period, detecting, by the controller, a malfunction indicative of a leaking or disconnected MUA hose.

In some implementations, the engine comprises distinct first and second banks of cylinders, wherein the MUA hose is connected to the crankcase via the first bank of cylinders, and wherein the crankcase ventilation system further comprises a PCV valve disposed along a PCV hose that connects the intake manifold of the induction system to the second bank of cylinders. In some implementations, the non-boost operating condition of the engine includes the PCV valve being open thereby fluidly connecting the intake manifold having an engine vacuum pressure level to the crankcase and the MUA hose. In some implementations, the non-boost operating condition of the engine is a stabilized, warm idle operating condition.

In some implementations, the method further comprises commanding, by the controller, the flow-limiting valve to open in response to a first of (i) the pressure drop reaching the threshold and (ii) an end of the diagnostic period. In some implementations, the flow-limiting valve defines an orifice sized to prevent a maximum vacuum level from being reached that could potentially damage seals of the engine. In some implementations, the boost system is a supercharger. In some implementations, the method further comprises in response to detecting the malfunction, at least one of (i) actuating, by the controller, an MIL and (ii) setting, by the controller, a DTC.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

As discussed above, there is a need for diagnostic systems and methods for crankcase ventilation systems that are capable of accurately detecting a leaking or disconnected make-up air (MUA) hose. This is particularly true for boosted engines (turbocharged, supercharged, etc.). The MUA hose provides fresh air to the engine crankcase to help purge the crankcase of blow-by vapors through a positive crankcase ventilation (PCV) valve and PCV hose and back into the engine intake manifold. One conventional solution is to utilize a pressure sensor disposed in-line along the MUA hose and monitor the measured pressure at certain engine operating conditions (e.g., mild acceleration) to detect pressure pulsations that could be indicative of a leaking or disconnected MUA hose. For boosted applications, however, there are often pressure pulsations in the MUA hose that are caused by the boost system and not by a leaking or disconnected MUR hose. This could lead to false passes (i.e., an undetected leaking/disconnected MUA hose) by the conventional pressure sensor-only solutions, which could result in increased costs.

Accordingly, an improved crankcase ventilation system diagnostic system and method are presented. These improved techniques utilize a flow-limiting valve to temporarily limit flow through the MUA hose for a diagnostic period during which a pressure drop in the MUA hose (as measured by the in-line pressure sensor) is monitored. These techniques could be performed during non-boost conditions, such as a stabilized, warm idle period of the engine, where vacuum conditions are present in the intake manifold (e.g., the PCV valve is opened and blow-by vapors are drawn from the crankcase through the PCV hose and into an intake manifold). That is, because engine vacuum is present in the PCV hose, this engine vacuum should cause the pressure in the MUA hose to decrease. If there is a leaking or disconnected MUA hose, however, there will be little or no pressure drop in the MUA hose because it is being exposed to atmospheric pressure. Thus, by comparing the pressure drop in the MUA hose across the diagnostic period to a threshold, a leaking or disconnected MUA hose is able to be detected.

Figure 1:
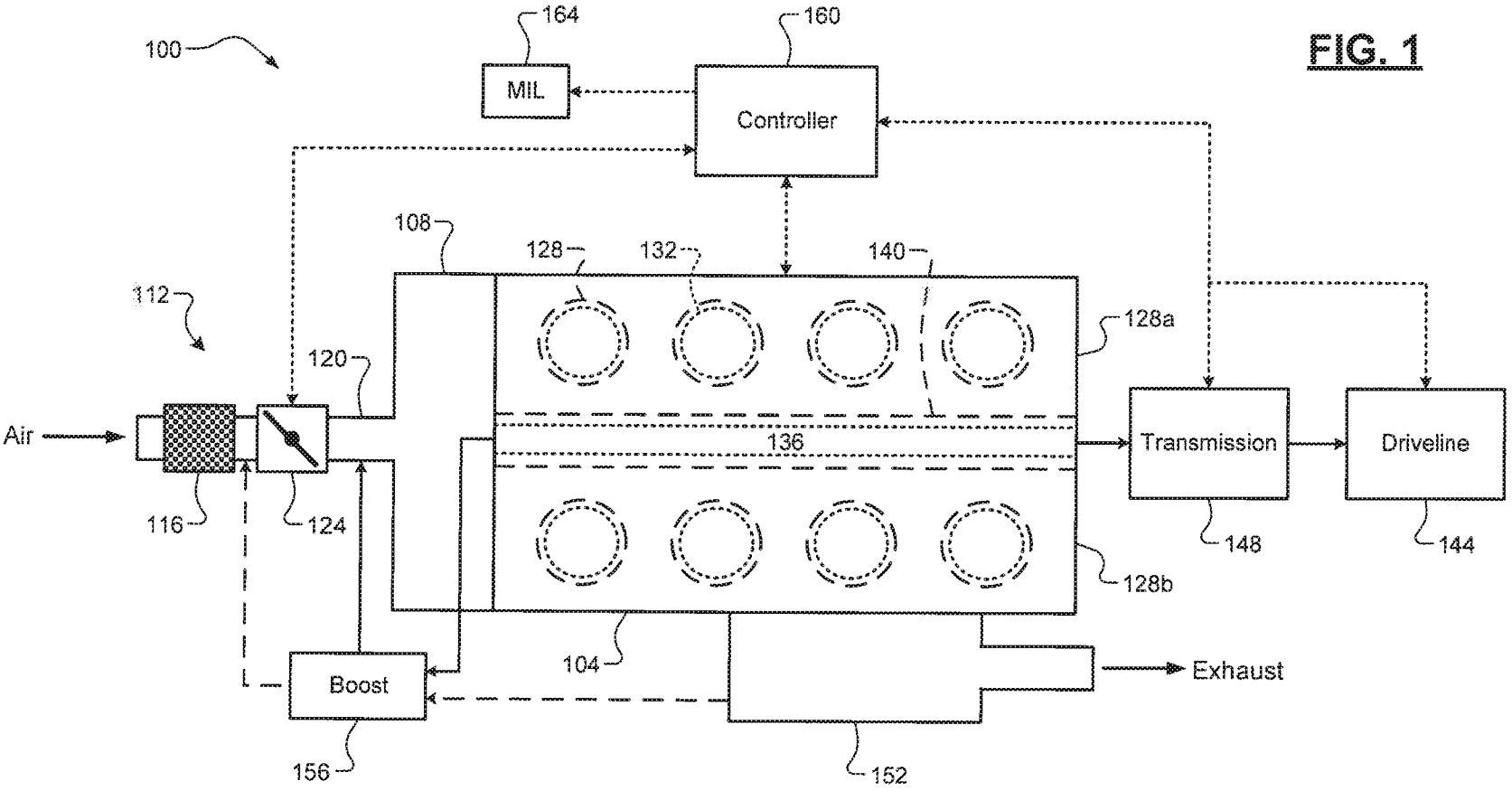
FIG. 1 is a diagram of an example engine system according to the principles of the present disclosure.

Referring now to FIG. 1, an example engine system 100 is illustrated. The engine system 100 includes an internal combustion engine 104 that is configured to combust an air/fuel mixture to generate drive torque to propel a vehicle, such as an automobile. The engine 104 is any suitable engine, such as a spark-ignition (SI) engine having direct or port fuel injection. The engine 104 draws fresh air into an intake manifold 108 through an induction system 112. The induction system 112 includes an air filter 116 that filters the fresh air and a fresh air duct 120 that provides the fresh air to the intake manifold 108. A throttle valve 124 controls the flow of fresh air into the intake manifold 108. The air in the intake manifold 108 is distributed to a plurality of cylinders 128 evenly arranged in two distinct cylinder banks **128*a*, 128*b*, e.g., in a V-configuration (see FIG. 2), or in-line in a single cylinder bank (e.g., an inline 4-cylinder engine). While eight cylinders are shown, it will be appreciated that the engine 104 could include any number of cylinders evenly arranged in two distinct banks of cylinders (4, 6, 10, 12, etc.). The air is combined with a fuel (e.g., gasoline from a fuel system, not shown) to form an air/fuel mixture in each of the cylinders 128**.

The air/fuel mixture is compressed within the cylinders 128 by pistons 132 and the compressed air/fuel mixture is ignited (e.g., by spark from an ignition system, not shown). The combustion of the compressed air/fuel mixture drives the pistons 132, which rotatably turn a crankshaft 136 to generate drive torque. The crankshaft 136 resides in a crankcase 140 that includes oil or another suitable lubricant for lubrication of the crankshaft 136. The drive torque at the crankshaft 136 is then transferred to a driveline 144 (e.g., axles or wheels of the vehicle) via a transmission 148, such as an automatic or manual transmission. Exhaust gas resulting from combustion is expelled from the cylinders 128 into an exhaust system 152, which then treats the exhaust gas to mitigate or eliminate emissions before release it into the atmosphere. For example only, the exhaust system 152 could include, among other devices, a three-way catalytic converter configured to mitigate or eliminate carbon monoxide (CO), hydrocarbon (HC), and nitrogen oxide (NOx) emissions.

A boost system 156 pressurizes or forces additional air into the intake manifold 108 and into the cylinders 128. This increased air charge, when combined with additional fuel, allows the engine 104 to generate a greater amount of drive torque. In one exemplary implementation, the boost system 156 is a supercharger having a compressor that is mechanically driven by the engine 104 (e.g., via the crankshaft 136 and a drive device, such as a chain or a belt). While the boost system 156 is hereinafter referred to as supercharger 156, it will be appreciated that the boost system could additional or alternatively include one or more turbochargers each having a turbine powered by the exhaust gas that in turn powers a respective compressor that increases the air charge into the engine. It will also be appreciated that the boost system 156 could include devices other than a compressor, such as a bypass valve/system. A controller 160 controls operation of the engine 104, such as controlling airflow into the engine (the throttle valve 124, the boost system 156, etc.), fuel, and spark. The controller 160 also selectively actuates a malfunction indicator lamp (MIL) 164.

Figure 2:
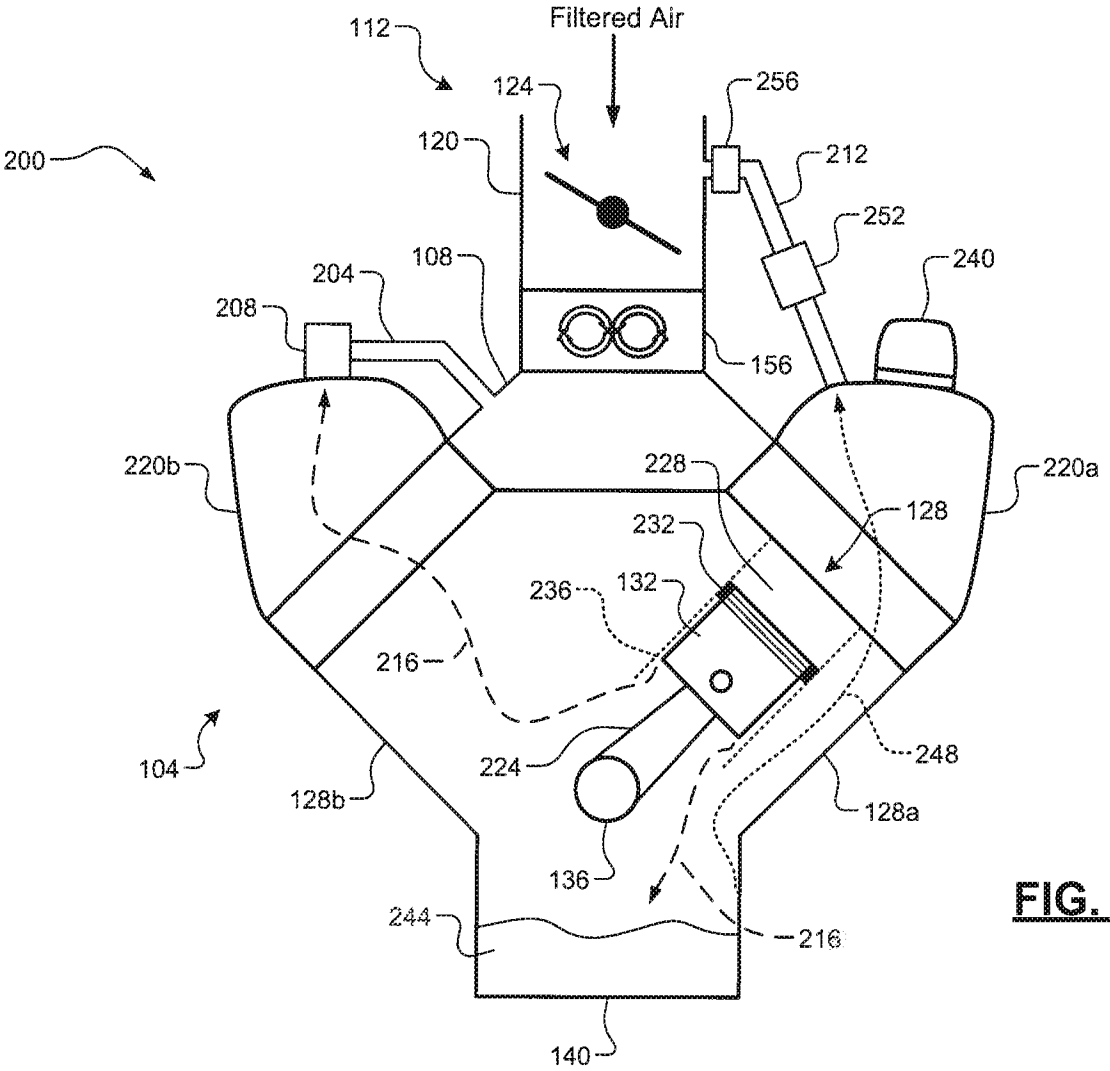
FIG. 2 is a diagram of an example crankcase ventilation system having a pressure sensor and a flow-limiting valve in-line along a make-up air hose according to the principles of the present disclosure.

Referring now to FIG. 2, an example crankcase ventilation system 200 is illustrated. While not necessarily shown, it will be appreciated that the crankcase ventilation system 200 may include other suitable components, such as check valves and/or other sensors. As shown, airflow into the intake manifold 108 of the engine 104 through the fresh air duct 120 is controlled by the throttle valve 124. The supercharger 156 is arranged downstream from the throttle valve 124 and forces the filtered air into the intake manifold 108, which enables the engine 104 to generate a greater amount of drive torque via combustion of a large air/fuel charge. While not explicitly shown, it will be appreciated that the supercharger 156 is mechanically driven either directly or indirectly (e.g., via a camshaft) by the crankshaft 136 via a drive device such as a chain or a belt (not shown). As previously noted herein, it will continue to be appreciated that the engine 104 could comprise one or more turbochargers for boost instead of the supercharger 156. For a turbocharged application, the boost will typically be present upstream of the throttle valve 124 (see dashed line in FIG. 1) and thus the positioning of the system components would be modified to account for this.

The crankcase ventilation system 200 generally includes a PCV line or hose 204, a PCV valve 208, and an MUA line or hose 212. The MUA hose 212 may also have a passive check valve (not shown) associated therewith that opens to permit flow through the MUA hose during certain operating conditions. When the PCV valve 208 is open, blow-by vapors 216 in the crankcase 140 are siphoned up to the PCV valve 208 through a first valve cover **220*b* associated with cylinder bank 128*b* due to engine vacuum in the intake manifold 108. Piston 132 is driven by the crankshaft 136 via a connecting rod 224. These blow-by vapors 216 include unburnt fuel (from the compression stroke of the piston 132) and/or exhaust gas (from the power stroke of the piston 132) that escape a combustion chamber 228 of the cylinder 128 past a piston ring 232 that is implemented to form a seal between the piston 132 and a wall 236 of the cylinder 128. These blow-by vapors 216 then enter the crankcase 140. A sealed oil filler cap 240 allows the crankcase 140 to be filled with oil 244. Fresh air is also provided to the crankcase 140 through the MUA hose 212 and a second valve cover 220*a* associated with cylinder bank 128*a*. If the MUA hose 212 were leaking or disconnected, however, these blow-by vapors could escape the crankcase 140 and be expelled into the atmosphere via the leaking/disconnected MUA hose 212**.

A pressure sensor 252 is configured to measure pressure in the MUA hose 212 or in the crankcase 140. For example, the pressure sensor 252 could be disposed in-line along the MUA hose 212, but it will also be appreciated that the pressure sensor 252 could be arranged at any other suitable point such that it is capable of measuring the pressure in the MUA hose 212. In order to detect a leaking or disconnected MUA hose 212, conventional solutions monitored pressure pulsations in the MUA hose 212. However, in boosted engines, these pressure pulsations are always occurring, particularly during boosted operating conditions. Thus, these pressure pulsations may be present even in the event of a leaking or disconnected MUA hose 212, which could result in false passes (i.e., an undetected leaking/disconnected MUA hose 212). The diagnostic techniques of the present disclosure therefore utilize a flow-limiting valve 256 that is fixedly attached to the induction system 112 or the intake manifold 108 proximate to an induction-system end of the MUA hose 212 and upstream from the pressure sensor 252. This fixed or permanent attachment is critical such that if the MUA hose 212 is disconnected, the flow-limiting valve 256 cannot come off still attached thereto. In one exemplary implementation, the flow-limiting valve 256 defines an orifice having a size designed to only limit flow until a certain maximum vacuum level in the crankcase 140 is reached in order to prevent potential damage to engine seals and/or other components. The flow-limiting valve 256 could be any suitable type of flow control valve, such as, but not limited to, an electronically controlled valve (e.g., a solenoid valve) and a mechanically controlled valve (e.g., a motorized valve or a rotary purge valve).

When the intrusive diagnostic routine of the present disclosure is initiated by the controller 160 (e.g., during non-boost operating conditions), the controller 160 takes an initial pressure reading by the pressure sensor 252 and then commands the flow-limiting valve 256 closed. One example of this non-boost operating condition is a stabilized, warm idle condition where the engine 104 is running at a stable idle speed and has been running long enough to achieve a desired stable operating temperature. During this diagnostic period, the controller 160 monitors the pressure drop in the MUA hose 212 as measured by the pressure sensor 252. If the pressure drop fails to fall below a threshold during the diagnostic period, the controller 160 detects a malfunction indicative of a leaking or disconnected MUA hose 212. In response to detecting this malfunction, the controller 160 could then activate the MIL 164 to indicate to the driver of the vehicle that service is required. The controller 160 could also take other action, such as setting a diagnostic trouble code (DTC) indicative of the leaking/disconnected MUA hose malfunction, which could then be retrieved by a vehicle technician during servicing.

Figure 3:
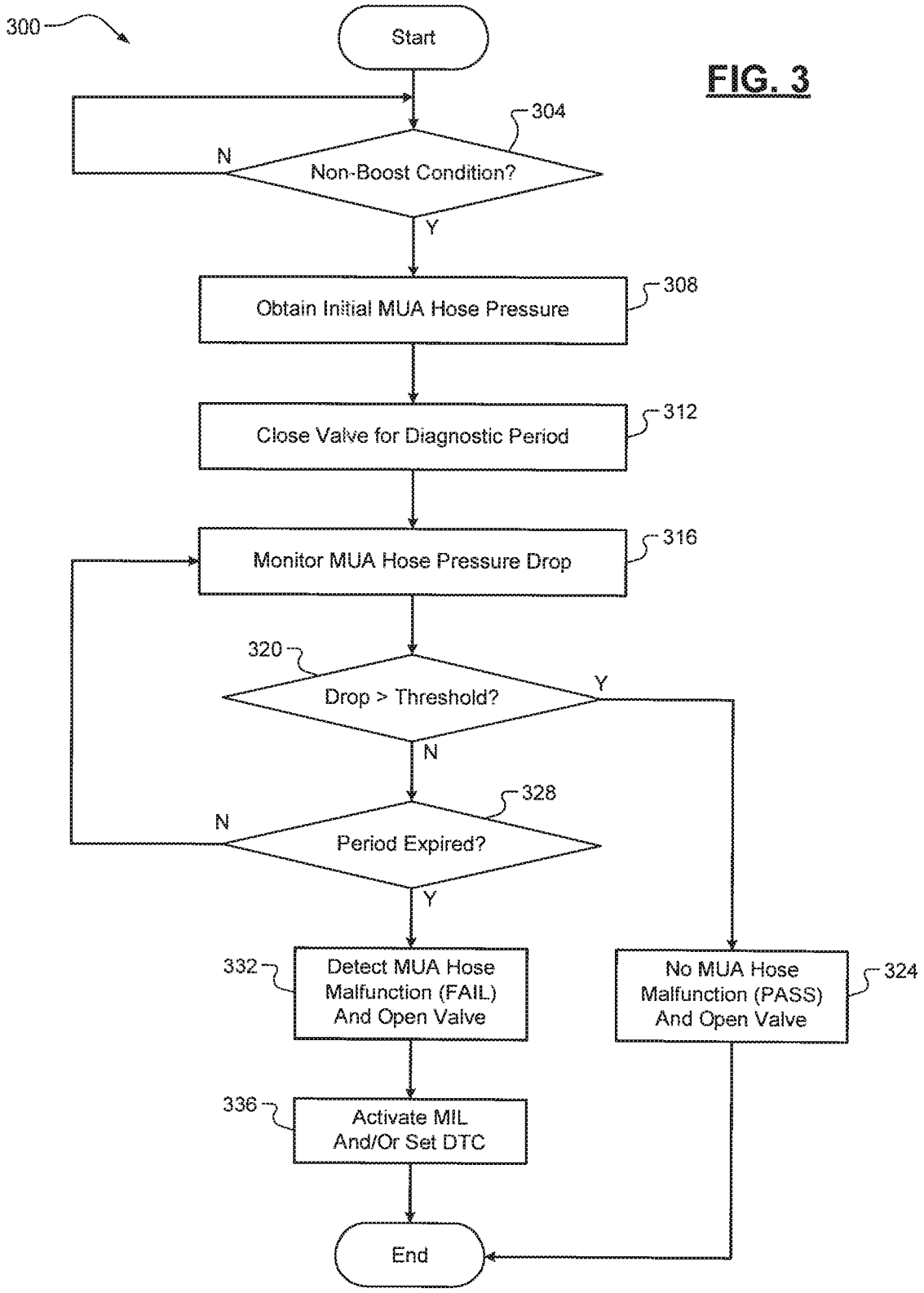
FIG. 3 is a flow diagram of an example diagnostic method for a crankcase ventilation system of an engine according to the principles of the present disclosure.

Referring now to FIG. 3, an example diagnostic method 300 for the crankcase ventilation system 200 of the engine 104 is illustrated. At 304, the controller 160 determines whether the engine 104 is operating at the non-boost operating condition. As previously discussed, this could be, for example only, a warm idle condition. When true, the method 300 proceeds to 308. Otherwise, the method 300 ends or returns to 304. At 308, the controller 160 obtains an initial pressure from the pressure sensor 252. At 312, the controller 160 then commands the flow-limiting valve 256 to close for a diagnostic period, thereby temporarily limiting or preventing flow through the MUA hose 212. Because the PCV valve 208 is open, however, engine vacuum from the intake manifold 108 is imparted on the crankcase 140 and the MUA hose 212. At 316, the controller 160 monitors the pressure in the MUA hose 212 during the diagnostic period to determine a pressure drop from the initial pressure.

It will be appreciated that the diagnostic period should have a duration that is calibrated to be long enough for robust leaking/disconnected MUA hose detection, but is otherwise as short as possible because the diagnostic method 300 is intrusive in that flow through the MUA hose 212 is being limited. At 320, the controller 160 determines whether the pressure drop has reached a threshold. This threshold is indicative of no leak or disconnection of the MUA hose 212 because the engine vacuum is decreasing the pressure therein as would be expected. When the pressure drop has reached the threshold, the method 300 proceeds to 324 where a pass status is determined for the MUA hose 212 (i.e., no leak or disconnect) and the method 300 ends or returns to 304. Otherwise, the method 300 proceeds to 328. At 328, the method 300 determines whether the diagnostic period has ended. When false, the method 300 returns to 316. When true, the method 300 proceeds to 332 where the controller 160 detects a malfunction indicative of a leaking/disconnected MUA hose 212. At optional 336, the controller 160 activates the MIL 164 and/or sets a DTC. The method 300 then ends or returns to 304.

It will be appreciated that the term "controller" as used herein refers to any suitable control device or set of multiple control devices that is/are configured to perform at least a portion of the techniques of the present disclosure. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture.

It should be understood that the mixing and matching of features, elements, methodologies and/or functions between various examples may be expressly contemplated herein so that one skilled in the art would appreciate from the present teachings that features, elements and/or functions of one example may be incorporated into another example, if appropriate, unless described otherwise above.

What is claimed is:

1. A diagnostic system for a crankcase ventilation system of an engine having a boost system, the diagnostic system comprising:

a pressure sensor configured to measure a pressure in a make-up air (MUA) hose or a crankcase of the crankcase ventilation system, the MUA hose connecting an induction system of the engine at a point upstream from an intake manifold of the engine to the crankcase;

a flow-limiting valve (i) fixedly attached to the induction system at a point upstream from the pressure sensor and proximate to an induction system end of the MUA hose and (ii) configured to limit flow through the MUA hose; and a controller configured to detect a non-boost operating condition of the engine and, in response to detecting the non-boost operating condition of the engine:

obtain an initial pressure from the pressure sensor, after obtaining the initial pressure, command the flow-limiting valve to close for a diagnostic period, during the diagnostic period, monitor the pressure using the pressure sensor to determine a pressure drop from the initial pressure, and when the pressure drop fails to exceed a threshold during the diagnostic period, detect a malfunction indicative of a leaking or disconnected MUA hose.

2. The diagnostic system of claim 1, wherein the engine comprises distinct first and second banks of cylinders, wherein the MUA hose is connected to the crankcase via the first bank of cylinders, and wherein the crankcase ventilation system further comprises a positive crankcase ventilation (PCV) valve disposed along a PCV hose that connects the intake manifold of the induction system to the second bank of cylinders.

3. The diagnostic system of claim 2, wherein the non-boost operating condition of the engine includes the PCV valve being open thereby fluidly connecting the intake manifold having an engine vacuum pressure level to the crankcase and the MUA hose.

4. The diagnostic system of claim 3, wherein the non-boost operating condition of the engine is a stabilized, warm idle operating condition.

5. The diagnostic system of claim 1, wherein the controller is further configured to command the flow-limiting valve to open in response to a first of (i) the pressure drop reaching the threshold and (ii) an end of the diagnostic period.

6. The diagnostic system of claim 1, wherein the flow-limiting valve defines an orifice sized to prevent a maximum vacuum level from being reached that could potentially damage seals of the engine.

7. The diagnostic system of claim 1, wherein the boost system is a supercharger.

8. The diagnostic system of claim 1, wherein in response to detecting the malfunction, the controller is further configured to at least one of (i) actuate a malfunction indicator lamp (MIL) and (ii) set a diagnostic trouble code (DTC).

9. A diagnostic method for a crankcase ventilation system of an engine having a boost system, the diagnostic method comprising:

detecting, by a controller of the engine, a non-boost operating condition of the engine; and in response to detecting the non-boost operating condition of the engine:

obtaining, by the controller, an initial pressure from a pressure sensor configured to measure a pressure in a make-up air (MUA) hose or a crankcase of the crankcase ventilation system, the MUA hose connecting an induction system of the engine at a point upstream from an intake manifold of the engine to the crankcase, after obtaining the initial pressure, commanding, by the controller, a flow-limiting valve closed for a diagnostic period, the flow-limiting valve being (i) fixedly attached to the induction system upstream from the pressure sensor and proximate to an induction system end of the MUA hose and (ii) configured to limit flow through the MUA hose, during the diagnostic period, monitoring, by the controller, the pressure using the pressure sensor to determine a pressure drop from the initial pressure, and when the pressure drop fails to exceed a threshold during the diagnostic period, detecting, by the controller, a malfunction indicative of a leaking or disconnected MUA hose.

10. The diagnostic method of claim 9, wherein the engine comprises distinct first and second banks of cylinders, wherein the MUA hose is connected to the crankcase via the first bank of cylinders, and wherein the crankcase ventilation system further comprises a positive crankcase ventilation (PCV) valve disposed along a PCV hose that connects the intake manifold of the induction system to the second bank of cylinders.

11. The diagnostic method of claim 10, wherein the non-boost operating condition of the engine includes the PCV valve being open thereby fluidly connecting the intake manifold having an engine vacuum pressure level to the crankcase and the MUA hose.

12. The diagnostic method of claim 11, wherein the non-boost operating condition of the engine is a stabilized, warm idle operating condition.

13. The diagnostic method of claim 9, further comprising commanding, by the controller, the flow-limiting valve to open in response to a first of (i) the pressure drop reaching the threshold and (ii) an end of the diagnostic period.

14. The diagnostic method of claim 9, wherein the flow-limiting valve defines an orifice sized to prevent a maximum vacuum level from being reached that could potentially damage seals of the engine.

15. The diagnostic method of claim 9, wherein the boost system is a supercharger.

16. The diagnostic method of claim 9, further comprising in response to detecting the malfunction, at least one of (I) actuating, by the controller, a malfunction indicator lamp (MIL) and (ii) setting, by the controller, a diagnostic trouble code (DTC).

* * * * *